US005868189A

United States Patent [19]

Jarvis

[11] Patent Number: 5,868,189

[45] Date of Patent: Feb. 9, 1999

[54] PROTECTIVE COVER FOR A PORTABLE ELECTRIC FAN

[76] Inventor: Robin A. Jarvis, 332-A St. Thomas Dr., Newport News, Va. 23606

[21] Appl. No.: 853,250

[22] Filed: May 9, 1997

Related U.S. Application Data

[60] Provisional application No. 60/025,037, Aug. 27, 1996.

[51] Int. Cl.[6] ..... B65D 65/02; B65D 65/08

[52] U.S. Cl. ..... 150/165; 150/154

[58] Field of Search ..... 150/154, 157, 150/165; 416/247 R

[56] References Cited

U.S. PATENT DOCUMENTS

| | | | |
|---|---|---|---|
| 772,214 | 10/1904 | Carney | 150/157 X |
| 1,489,704 | 4/1924 | Kleshick | 150/165 |
| 1,751,793 | 3/1930 | Cook | 416/247 R |
| 2,036,478 | 4/1936 | Hoff et al. | 416/247 R |
| 2,417,636 | 3/1947 | Ditzler et al. | 150/157 X |
| 2,763,428 | 9/1956 | Selah | 416/247 R |
| 2,812,900 | 11/1957 | Matthews | 416/247 R |
| 2,958,357 | 11/1960 | Vorgan | 369/176 |
| 5,664,975 | 9/1997 | Carlisle | 150/154 X |

FOREIGN PATENT DOCUMENTS

| | | |
|---|---|---|
| 803089 | 9/1936 | France . |
| 3722 | 9/1919 | Netherlands . |
| 782709 | 9/1957 | United Kingdom . |

*Primary Examiner*—Sue A. Weaver
*Attorney, Agent, or Firm*—Richard C. Litman

[57] ABSTRACT

A removable cover protects an electric fan when it is stored or not in operative use. The removable fan cover is fabricated of flexible machine-washable material which protects the fan blade structure from dust, dirt and moisture accumulation during its storage or non-use. One or more closure fasteners, such as snaps or two-way zippers, are utilized to secure the rear section of the cover whereby the cover is maintained in a firm and snug relationship around the fan blade structure.

3 Claims, 4 Drawing Sheets

PROTECTIVE COVER FOR A PORTABLE ELECTRIC FAN

CROSS REFERENCE TO RELATED APPLICATIONS

This application claims the benefit of U.S. Provisional application Ser. No. 60/025,037 filed Aug. 27, 1996.

BACKGROUND OF THE INVENTION

1. Field of the Invention

The present invention relates generally to a protective cover for a portable electric fan. More specifically, the present invention relates to a removable fan cover fabricated of a flexible machine-washable material for protecting the fan blade structure when the fan is not in operative use.

2. Description of Prior Art

Fan covers are old in the prior art, especially wire fabric fan covers for protecting users during operation of the fan, as exemplified by the following patents.

U.S. Pat. No. 1,489,704, issued on Apr. 8, 1924 to Frank P. Kleshick, describes a portable fan cover which covers the entire fan, except its supporting base. U.S. Pat. No. 1,751,793, issued on Mar. 25, 1930 to Emma K. Cook, discloses a fan cover made of a wire screening material. U.S. Pat. No. 2,036,478, issued on Apr. 7, 1936 to Charles E. Hoff, describes a wire guard for a motor driven fan. U.S. Pat. No. 2,763,428, issued on Sep. 18, 1956 to Robert D. Selah, describes a fan safety guard of wire mesh. U.S. Pat. No. 2,812,900, issued on Nov. 12, 1957 to Charles L. Matthews, describes a protective guard made of cotton mesh for an electric fan. U.S. Pat. No. 2,958,357, issued on Nov. 1, 1960 to Harry Vorgan, discloses a collapsible plastic cover for enclosing and protecting a phonograph record player and the like. French Patent Document Number 803,089, dated Sep. 22, 1936, shows an attachment for a table cover. British Patent Document Number 782,709, dated Sep. 11, 1957, shows a cover for a crated carboy. Netherlands Patent Document Number 3,722, dated Nov. 15, 1916, appears to show a fan cover. However, none of the above prior art patents describe or suggest the use of a removable fan cover which is fabricated of a flexible machine-washable material and which protects the fan blade structure from dust, dirt and moisture accumulation when the fan is not in operative use.

None of the above inventions and patents, taken either singly or in combination, is seen to describe the instant invention as claimed.

SUMMARY OF THE INVENTION

The present invention relates to a removable cover which protects an electric fan when it is not in operative use. The fan cover is fabricated of flexible machine-washable material which protects the fan blade structure from dust, dirt and moisture accumulation during its non-use. One or more closure fasteners, such as snaps or two-way zippers, are utilized to secure the rear section of the cover whereby the cover is maintained in a firm and snug relationship around the fan blade structure.

Accordingly, it is a principal object of the invention to provide a removable fan cover fabricated of a flexible machine-washable material whereby the cover may be easily cleaned after use.

It is another object of the invention to provide a removable fan cover designed to protect the fan blade structure from dust, dirt and moisture accumulation when the fan is not in operative use.

It is a further object of the invention to provide a removable fan cover which utilizes one or more closure fasteners to secure the rear section of the cover whereby the cover is maintained in a firm and snug relationship around the fan.

Still another object of the invention is to provide a removable fan cover which is simple to fabricate and to market.

It is an object of the invention to provide improved elements and arrangements thereof in a fan cover for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
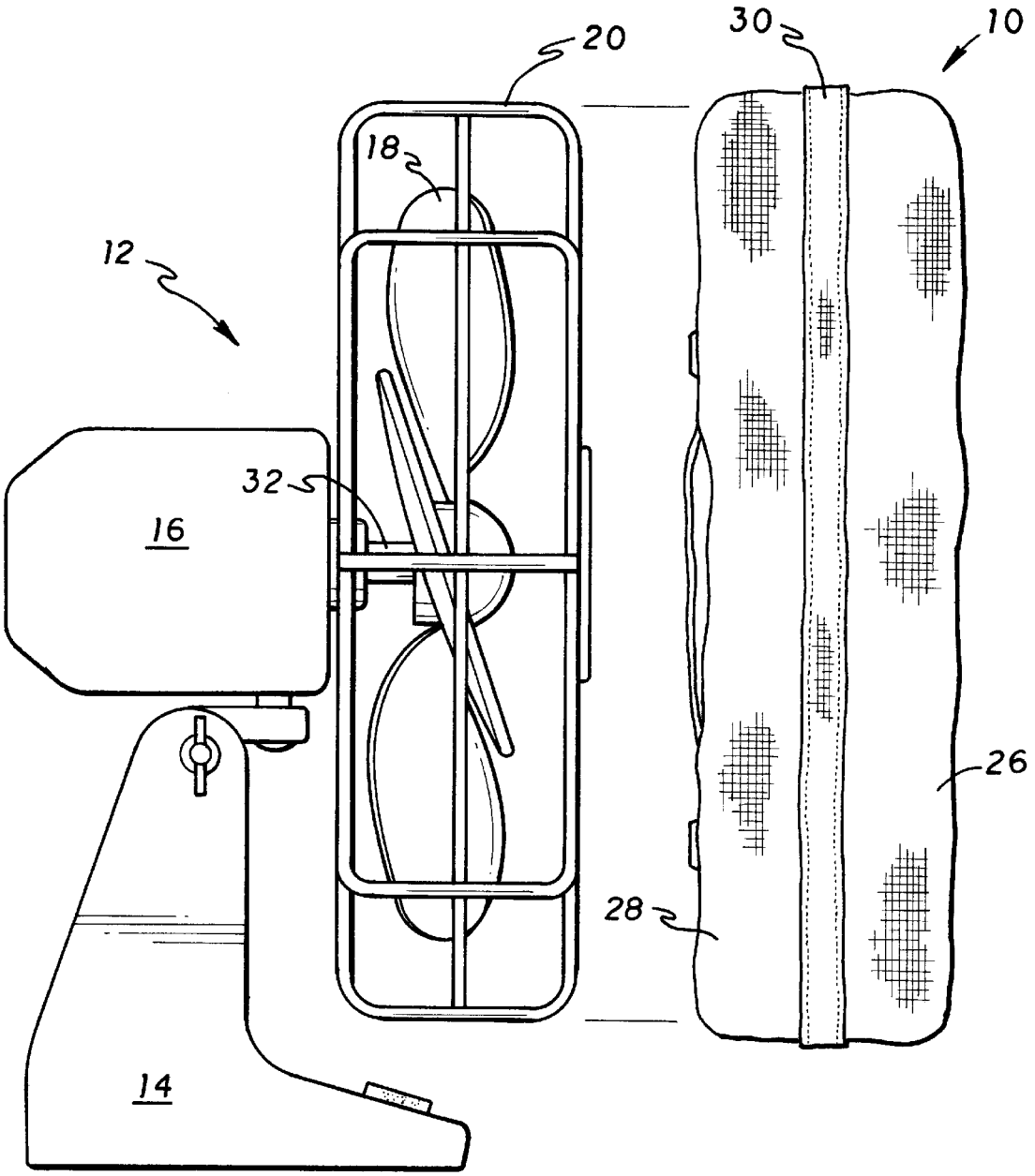
FIG. 1 is a side elevational view of a fan cover of the present invention removed from an electric fan.
Figure 2:
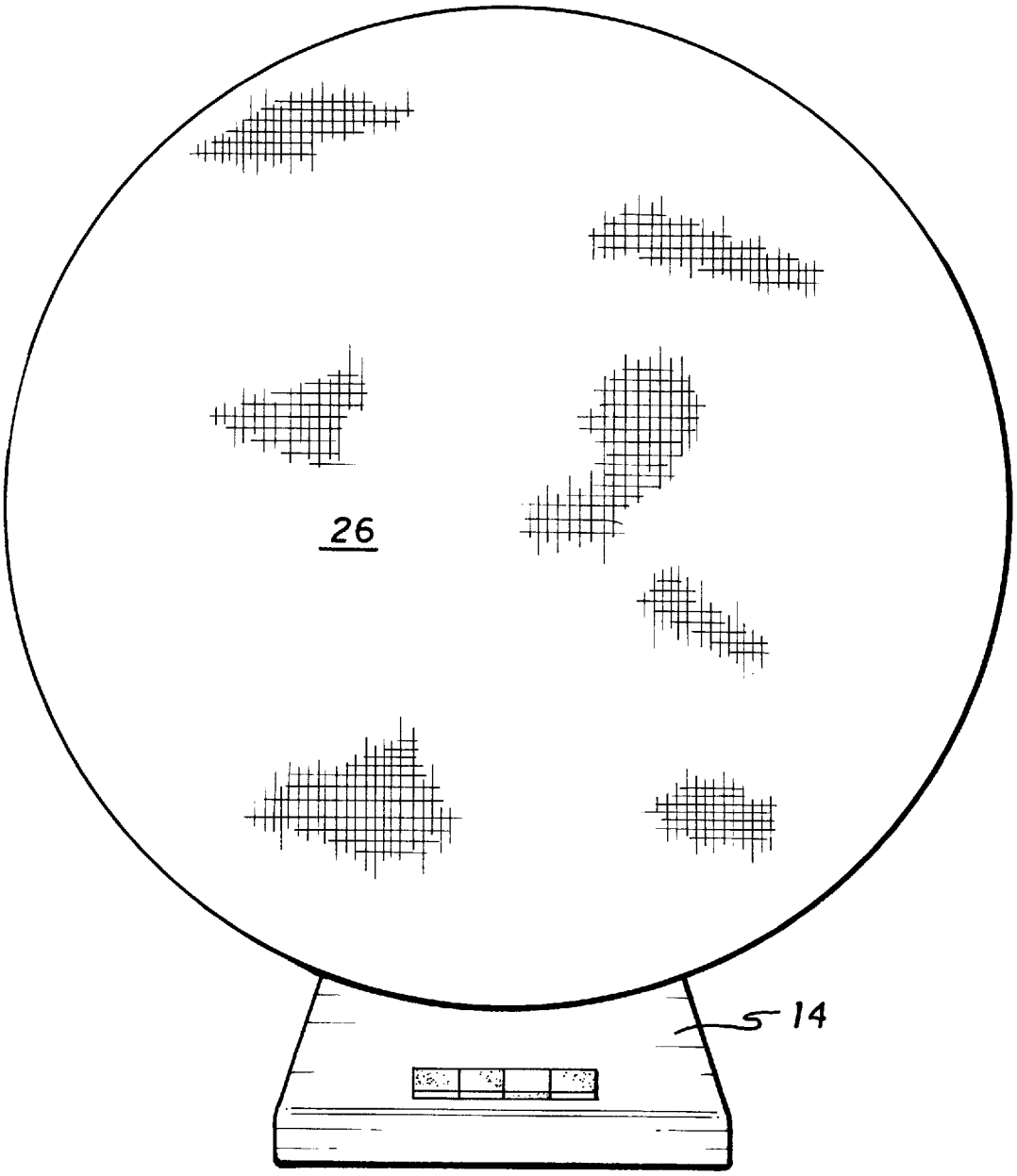
FIG. 2 is a front view of an electric fan with an installed fan cover of the present invention.

In its broadest aspect of the present invention and with reference to FIG. 1, there is shown a removable fan cover 10 and a conventional electric fan 12, the cover 10 being removed for illustrative purposes. The fan 12 includes a pedestal base 14, a housing 16 for housing an electric motor and a fan blade structure 18 enclosed by a grill guard 20. In the instant invention, the purpose of the removable fan cover 10 is to protect the fan blade structure 18 from dust, dirt and moisture accumulation when the fan 12 is not in operative use. The fan cover 10, as seen in FIGS. 1–4 is made of flexible machine-washable material which may be easily cleaned after being used. One or more closure fasteners, such as the pair of snap fasteners 22 shown in FIG. 3 or the pair of two-way zipper fasteners 24 shown in FIG. 4, secure the rear section of the cover 10 whereby the cover 10 is maintained in a firm and snug relationship around the grill guard 20 which houses the fan blade structure 18.

More specifically, the removable fan cover 10 is for use during storage or a non-operative use period of time of the electric fan 12. As seen in FIG. 1, the fan cover 10 has a front member 26 and a back member 28, separated by an elongated band member 30. Each of the members 26, 28 has a configuration resembling a substantially semi-spherical shape. Each of the members 26, 28 has peripheral edges. The elongated band member 30 joins by stitching and the like, the peripheral edges of the front and back members 26, 28 together to form a circular box-shaped enclosure which houses the circular box-shaped grill guard 20, which in turn houses the fan blade structure 18. Thus, the fan cover 10 is dimensioned and configured to cover the fan blade structure 18 and to protect the fan blade structure 18 from dust, dirt and moisture accumulation when the fan 12 is not in operative use.

Figure 3:
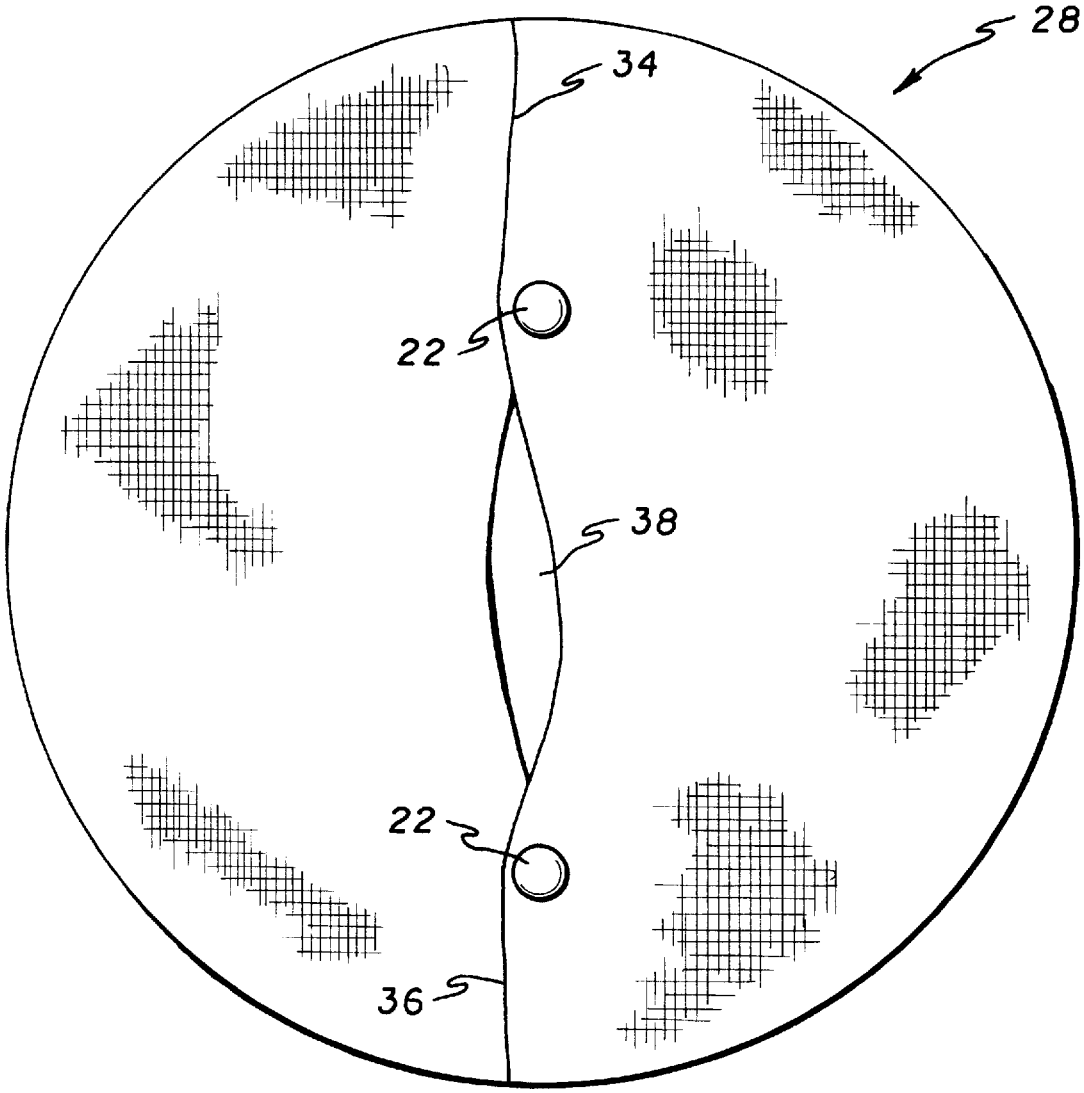
FIG. 3 is a rear view of an embodiment of a fan cover of the present invention, showing snap fasteners and details of an elongated slit.
Figure 4:
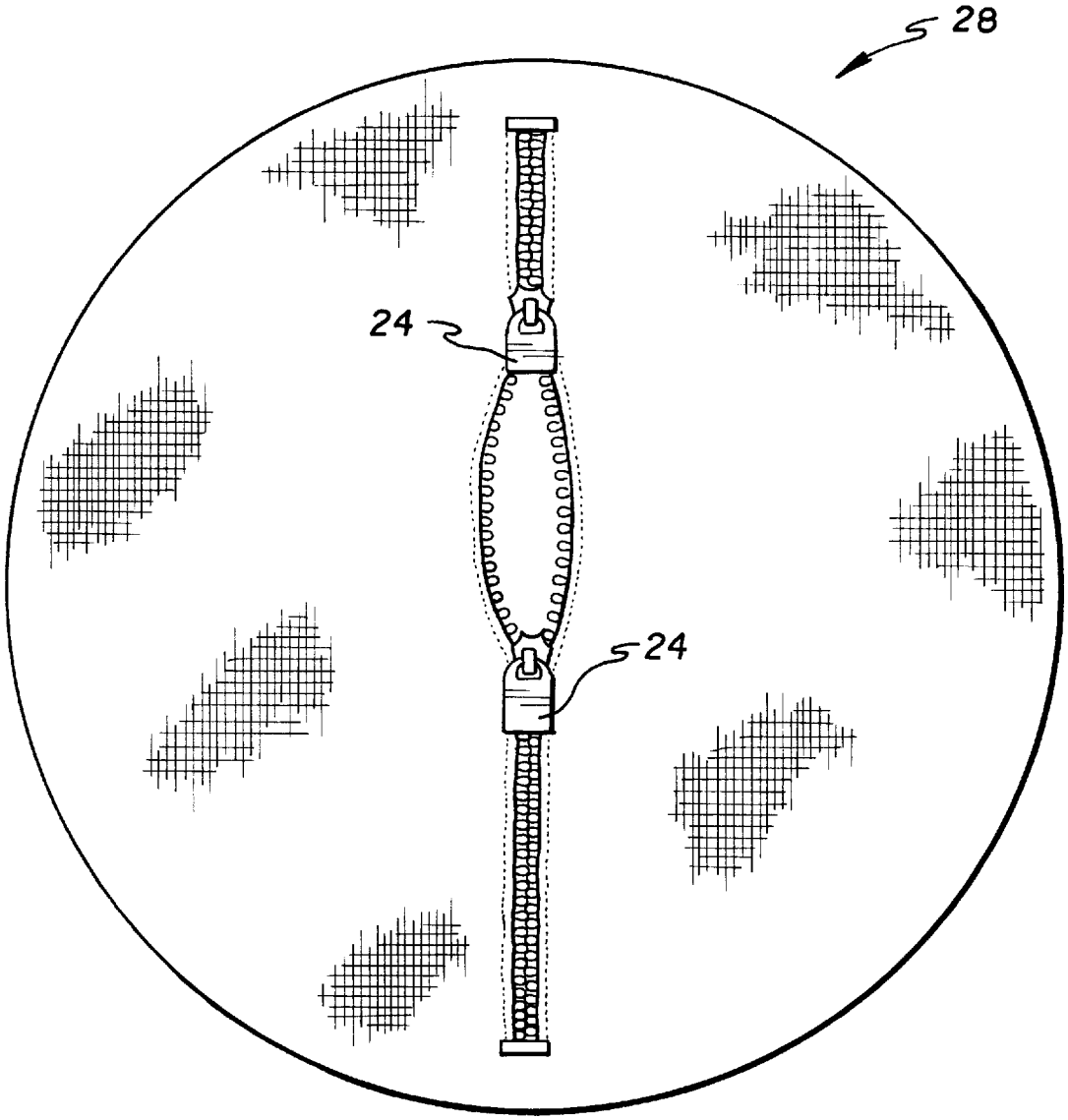
FIG. 4 is a rear view of a second embodiment of a fan cover of the present invention, showing a two-way zipper unit thereon.

The motor in the housing 16 is connected to the fan blade structure 18 by a motor drive shaft 32. To accommodate an opening in the back member 28 of the cover 10 for receiving the motor drive shaft 32, the back member 28 is bifurcated by an elongated vertically-positioned slit. As seen in FIG. 3 (and also in FIG. 4) the elongated slit extends substantially the diametrical length of the back member 28. For purposes of discussion of the instant invention, the elongated slit is considered to have an upper portion 34, a lower portion 36 and a median portion which is an open slot 38. The open slot 38 receives the motor drive shaft 32. The upper and lower portions 34, 36 of the elongated slit are respectively closed by operating the fasteners 22 or 24. Thus, when the fan 12 is not being used, the fan cover 10 is placed over the fan blade structure 18 and the fasteners 22, 24 are snapped or zipped whereby the fan blade structure 18 is enclosed during storage. The fan cover 10 and the band member 30 are made of flexible machine-washable material whereby the cover may be easily cleaned after use.

Various modifications may be made to the present invention. For example, one closure fastener unit may be utilized in lieu of the above disclosed pair of closure fasteners. Further, other types of fasteners may be substituted for the snap and zipper fasteners disclosed herein.

It is to be understood that the present invention is not limited to the embodiments described above, but encompasses any and all embodiments within the scope of the following claims.

I claim:

1. A removable fan cover for use during storage or a non-operative period of time of an electric fan having a motor shaft connected to a fan blade structure, comprising:

a protective cover having a front member and a back member; each of said front and back members made of flexible machine-washable material and having peripheral edges, a semi-spherical shape, and being dimensioned and configured to cover the fan blade structure;

an elongated band member made of flexible machine-washable material joining said front and back peripheral edges together and forming a housing for substantially enclosing the fan blade structure therein;

said back member being bifurcated by an elongated vertically-positioned slit extending substantially the length of a diametrical length of said back member; said slit having an upper portion, a lower portion and a median portion between said upper portion and said lower portion; and, first fastener means associated with said upper portion and second fastener means associated with said lower portion for securing said slit together; said median portion of said slit forming a slot for a passageway of the fan motor shaft; said first and second fastener means being operative during closure of said fan cover around the fan blade structure;

whereby said fan cover is maintained in a firm and snug relationship around the fan blade structure during storage or a non-operative period of time, and protects the fan blade structure from dust, dirt and moisture accumulation.

2. The fan cover according to claim 1, wherein said first and second fastener means are snap fasteners.

3. The fan cover according to claim 1, wherein said first and second fastener means are two-way zipper fasteners.

* * * * *